US006766232B1

(12) United States Patent
Klausner

(10) Patent No.: US 6,766,232 B1
(45) Date of Patent: Jul. 20, 2004

(54) METHOD FOR RECOGNITION OF FAULTS ON A MOTOR VEHICLE

(75) Inventor: Markus Klausner, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 231 days.

(21) Appl. No.: 09/913,239

(22) PCT Filed: Oct. 26, 2000

(86) PCT No.: PCT/DE00/03778

§ 371 (c)(1),
(2), (4) Date: May 9, 2002

(87) PCT Pub. No.: WO01/43079

PCT Pub. Date: Jun. 14, 2001

(30) Foreign Application Priority Data

Dec. 9, 1999 (DE) ..... 199 59 526

(51) Int. Cl.[7] ..... G07C 5/08
(52) U.S. Cl. ..... 701/33; 701/35; 701/29
(58) Field of Search ..... 701/29, 31, 33, 701/35; 73/116, 117.2, 117.3

(56) References Cited

U.S. PATENT DOCUMENTS 5,099,436 A * 3/1992 McCown et al. ..... 702/82
5,377,112 A * 12/1994 Brown et al. ..... 701/115
5,442,553 A * 8/1995 Parrillo ..... 455/420
5,528,516 A 6/1996 Kliger et al.
5,729,452 A 3/1998 Frost et al.
5,732,676 A * 3/1998 Weisman et al. ..... 123/436
5,737,215 A 4/1998 Sarangapani et al.
5,781,871 A * 7/1998 Mezger et al. ..... 455/424
5,809,437 A * 9/1998 Breed ..... 701/29
5,919,267 A 7/1999 Urnes et al.
6,301,531 B1 * 10/2001 Pierro et al. ..... 701/29
6,546,363 B1 * 4/2003 Hagenbuch ..... 703/7

FOREIGN PATENT DOCUMENTS

| | | |
|---|---|---|
| DE | 198 12 318 | 9/1999 |
| DE | 198 49 328 | 5/2000 |
| FR | 2 656 439 | 6/1991 |

* cited by examiner

*Primary Examiner*—Michael J. Zanelli
(74) *Attorney, Agent, or Firm*—Kenyon & Kenyon

(57) ABSTRACT

A method for the detection of errors in a motor vehicle, performance characteristics and information for characterizing the performance characteristics being recorded in a motor vehicle over a specific period of time. To make possible a predictive detection of errors in a motor vehicle at a high degree of reliability, a method is proposed having the following steps: From the performance characteristics recorded before the occurrence of a specific error in the motor vehicle, a performance characteristics model is generated, which is assigned to the error. The performance characteristics model is described in an appropriate form (rules and/or mathematical functions), and the currently recorded performance characteristics are compared during the operation of the motor vehicle with the descriptions of the performance characteristics models characterizing the errors.

8 Claims, 2 Drawing Sheets

METHOD FOR RECOGNITION OF FAULTS ON A MOTOR VEHICLE

FIELD OF THE INVENTION

The present invention relates to a method for detecting errors in a motor vehicle, performance characteristics and information for characterizing the performance quantities in a motor vehicle being recorded over a preestablished period of time. The present invention also relates to a diagnostic device for the predictive detection of errors in a motor vehicle.

BACKGROUND INFORMATION

From the related art, it is known to carry out preventive maintenance on a motor vehicle based on the driving performance or the hours of operation. For this purpose, in the motor vehicle specific performance characteristics (e.g., driving performance or the operational life) are recorded over a preestablished period of time and are stored in memory. If the performance characteristics reach a preestablished value, then a check or an exchange of certain parts, components, and/or operational equipment of the motor vehicle is carried out. In the known preventive maintenance, reliance is placed on empirical values, which parts, components, and/or operational equipment need to be checked or exchanged, if certain performance characteristics have reached a preestablished value. These empirical values can deviate from the actual situation in the motor vehicle in some cases significantly. Thus, by way of example, it can happen that the effective parts, components, and/or operational equipment were not checked or exchanged, because the corresponding performance characteristics had not yet reached a preestablished value. The consequences are a defective motor vehicle, an unscheduled garage visit, and possibly even other subsequent errors due to the error arising in the motor vehicle. On the other hand, in preventive maintenance, the case can also arise that completely intact parts, components, and/or operational equipment are checked or exchanged, only because the corresponding performance characteristics reached a preestablished value. This leads to additional unnecessary labor and costs.

From German Published Patent Application No. 198 49 328, it is known to record performance characteristics in a motor vehicle over a preestablished period of time, and to store them. On the basis of the stored performance characteristics, after an error has occurred in the motor vehicle, it is possible to localize the error. However, this method only makes it possible to diagnose an error after it has already occurred. A predictive diagnosis, i.e., detecting an error even before it has actually occurred, is not possible using this method. Using the known method, an unscheduled garage visit and possible secondary errors due to the error that has occurred cannot be avoided in the motor vehicle.

From U.S. Pat. No. 5,528,516, a method is known for detecting errors in a complex system on the basis of observable performance characteristics. Cited as complex systems in which the known method can be used are, inter alia, complex vehicles such as a spaceship; its use in motor vehicles is not mentioned. In the exemplary embodiments, the known method for detecting errors in a computer network and in a satellite system is described. It is also noted to use the known method for the medical diagnosis of a patient's symptoms. In the described method, performance characteristics of the complex system are recorded and stored over a preestablished period of time. In response to the occurrence of a specific error, a performance characteristics model, to which the error is assigned, is generated from the recorded performance characteristics. Redundant or unnecessary information is eliminated from the performance characteristics model. On the basis of the reduced performance characteristics model, it is possible then to identity and localize an error that is occurring in the complex system. Error prediction is not possible using the known system.

Furthermore, the known method is used in each case for an individual complex system. No thought has been given to combining the performance characteristics models generated from a plurality of complex systems. This has the disadvantage that the performance characteristics models must be generated for each individual system to be diagnosed, and the results cannot be transferred to other complex systems in a simple manner.

From the described disadvantages of the related art, the objective of the present invention arises to make possible a predictive detection of errors in a motor vehicle, enjoying a high degree of reliability.

To achieve this objective, from a baseline of the method for detecting errors in a motor vehicle of the type cited above, the present invention proposes a method which is characterized by the following steps:

- from the performance characteristics recorded in the motor vehicle before the onset of a specific error, a performance characteristics model is generated which is assigned to the error;
- the performance characteristics model is described in a suitable form; and
- the currently recorded performance characteristics are compared during the operation of the motor vehicle, with the descriptions of the performance characteristics models that are characteristic of the errors.

SUMMARY OF THE INVENTION

In a motor vehicle, performance characteristics are recorded over a specific period of time, which can be different from motor vehicle to motor vehicle. By performance characteristics are meant all the information which describes the condition of the motor vehicle and its environment. For example, this denotes the signals from sensors located in the motor vehicle. In addition, information is recorded for characterizing the performance characteristics, for example, the condition of systems, including error codes that arise, as well as date, time and/or location of the performance characteristics record. The recorded performance characteristics and information can be stored for the purpose of subsequent retrieval. The recorded performance characteristics are stored, for example, in the form of vectors, the individual vector elements corresponding to the values of the performance characteristics at specific points in time.

When a specific error has arisen in the motor vehicle, the error is identified. It can be, for example, the failure of a specific component or an unusual signal from a specific sensor. The identification of the error that has arisen takes place on the basis of the recorded performance characteristics and the recorded information for characterizing the performance characteristics in a manner that is generally known from the related art. From the performance characteristics recoded before the occurrence of the error, a so-called performance characteristics model is generated, which is assigned to the identified error, Processing the recorded performance characteristics in order to identify the error can take place either in the context of an on-board diagnosis within the motor vehicle or outside of the motor vehicle in a garage. The performance characteristics model is stored, for example, in the form of a matrix, the individual matrix elements corresponding to the values of different performance characteristics at specific points in time. In particular, the time points before the occurrence of the error and those performance characteristics that are influenced by the error are observed.

Outside the motor vehicle, the performance characteristics model is then described using appropriate rules and/or mathematical functions (e.g, convolution). The description of the performance characteristics model aids in simplification and therefore in saving memory space and computing resources in a computer of the motor vehicle. Finally, the descriptions of the performance characteristics model are transmitted to the motor vehicle and there, during the operation of the motor vehicle, they are compared with the currently recorded performance characteristics.

During the operation of the motor vehicle, for the predictive diagnosis of errors in the motor vehicle, currently recorded performance characteristics are compared with the previously determined descriptions of the performance characteristics models, which are assigned to different errors. Before an error arises in the motor vehicle, specific performance characteristics take on specific values, which are characteristic for the respective error. By comparing the currently recorded performance characteristics with the descriptions of the performance characteristics models, these kinds of changes in the performance characteristics can be ascertained.

Using the method according to the present invention, very complex, non-modelable correlations can be depicted. Using the method according to the present invention, it is possible with a high degree of probability to predict an error in the motor vehicle that will occur in the future, even if the recorded performance characteristics do not have a causal relation to the error that is arising. Even before the error has occurred, appropriate countermeasures can thus be carried out and secondary errors can be avoided.

The prediction of errors in the motor vehicle can take place in connection with a statement regarding the reliability of the prediction, i.e., concerning the probability with which the predicted error can be considered likely to actually occur in the future. The closer the occurrence of an error approaches, the more reliably it can be predicted that the error will occur.

The method according to the present invention makes possible the predictive detection of errors in a motor vehicle even before the error bas occurred and before more serious damage or secondary errors have arisen.

According to one advantageous refinement of the present invention, it is proposed that a specific performance characteristics model be assigned to a specific error on the basis of performance characteristics recorded in a plurality of motor vehicles. This refinement assumes that each specific error occurs in a plurality of motor vehicles (usually at different points in time). Therefore, the performance characteristics recorded before the occurrence of a specific error are transmitted, along with the diagnosed error, to a central, vehicle-external error storage unit. In the error storage unit, performance characteristics of a multiplicity of motor vehicles are stored along with the assigned errors. On the basis of the performance characteristics recorded in a plurality of motor vehicles, forming the basis of the same error, a performance characteristics model is generated in the vehicle-external error storage unit, this error being assigned to the performance characteristics model. By evaluating the performance characteristics of a plurality of motor vehicles, the meaningfulness of the performance characteristics models can be improved and the reliability of the prediction of a specific error can be significantly increased.

To determine the error-specific performance characteristics model, the performance characteristics of a motor vehicle having an error are compared with the performance characteristics of those motor vehicles that do not have this error. Similarly, the performance characteristics models assigned to a specific error can be compared with each other with respect to similarity, or agreement. For this purpose, various algorithms and methods known from the related art in the area of data mining or of knowledge discovery can be used. Advantageously, the same time period is taken as a basis for the comparison of the performance characteristics, i.e., all of the performance characteristics are standardized based on the same relative time basis. The goal of determining the performance characteristics model from the recorded performance characteristics is to clarify which performance characteristics and combinations of performance characteristics permit an unambiguous characterization of a specific error, which mathematical relation obtains between the individual performance characteristics, and from which point in time, before the occurrence of a specific error, the characteristic performance characteristics can be observed.

According to one preferred embodiment of the present invention, it is proposed that in the motor vehicles of one specific type, the same performance characteristics be recorded in each case. If in one motor vehicle, for example, the functioning of the internal combustion engine is monitored, then advantageously the same performance characteristics are recorded in the motor vehicles having the same type of internal combustion engine. In this manner, the performance characteristics of a plurality of motor vehicles of the same type can better be compared with each other to determine the performance characteristics model.

According to a further advantageous refinement of the present invention, it is proposed that the recorded performance characteristics, the information for characterizing the performance characteristics, and the errors occurring be transmitted from motor vehicles of one specific type to an error storage unit arranged outside of the motor vehicles, and be stored there. The vehicle-external error storage unit is connected, for example, via a data network, to garages in which the motor vehicles are serviced. In the garages, the performance characteristics are read out from the individual motor vehicles and are transmitted to the vehicle-external error storage unit. Since in the vehicle-external error storage unit the performance characteristics and the errors that have occurred are brought together from a plurality of motor vehicles, they can be processed there together. The performance characteristics are advantageously transmitted from the individual motor vehicles to the vehicle-external error storage unit using wireless transmission methods.

According to another preferred embodiment of the present invention, it is proposed that a specific performance characteristics model be assigned to a specific error on the basis of the performance characteristics stored in the vehicle-external error storage unit.

According to a further advantageous refinement of the present invention, it is proposed that trivial correlations be eliminated from the descriptions of the performance characteristics models. Trivial is understood to mean, for example, the circumstance that, when a sensor fails, the corresponding performance characteristics value disappears i.e., lies outside of an expected range. Trivial correlations of this type are eliminated in the context of determining the descriptions of the performance characteristics models, because the performance characteristics models are determined with the goal of establishing the non-trivial correlations between the performance characteristics and the errors that have arisen. Non-trivial correlations are, for example, unexpected correlations or those that can be modeled with difficulty or not at all. Furthermore, it is possible to eliminate redundant and unnecessary information from the performance characteristics models.

According to another advantageous refinement of the present invention, it is proposed that the correlation between a performance characteristics model and the occurrence of a specific error is presented as a rule. The correlations that are obtained by analyzing the performance characteristics are presented in the form of rules or algorithms. The rules describe which performance characteristics curves, or combinations of performance characteristics curves, lead to a specific error. The rules also describe in which time period before the occurrence of the error this characteristic performance characteristics model can be observed. Alternatively, or in addition, it is proposed that the correlation between a performance characteristics model and the occurrence of a specific error be described using a mathematical function (e.g., a convolution).

The actual implementing of the method for the predictive detection of errors in a motor vehicle can take place in two fundamentally different forms:

on the one hand, in a vehicle-internal diagnostic device in the motor vehicle, or on the other band, in a vehicle-external diagnostic device, which is located, for example, in a garage.

Therefore, according to one preferred refinement of the present invention, it is proposed that the descriptions of the performance characteristics models generated be transmitted from the vehicle-external error storage unit to a vehicle-internal diagnostic device in the motor vehicle, the currently recorded performance characteristics being compared in the vehicle-internal diagnostic device to the descriptions of the performance characteristics models. The currently recorded performance characteristics are compared with the rules, or the functions are applied to them. In this specific embodiment, the predictive diagnosis can be carried out while the motor vehicle is being driven.

Alternatively, it is proposed that the currently recorded performance characteristics be transmitted from the motor vehicle to a vehicle-external diagnostic device which has access to the vehicle-external error storage unit, the currently recorded performance characteristics being compared in the vehicle-external diagnostic device with the descriptions of the performance characteristics models. The currently recorded performance characteristics are compared with the rules, or the functions are applied to them.

As a further way to achieve the present objective, the present invention proposes a diagnostic device for the predictive detection of errors in a motor vehicle. A diagnostic device of this type can be arranged within the motor vehicle, for example, as part of a control device of the motor vehicle, or outside the motor vehicle in a garage.

In the diagnostic device, the empirically ascertained descriptions of the performance characteristics models assigned to specific errors are compared during the operation of the motor vehicle to the currently recorded performance characteristics. The correlations between the performance characteristics models and the occurrence of a specific error are stored in the diagnostic device, for example, as rules.

DETAILED DESCRIPTION

Figure 1:
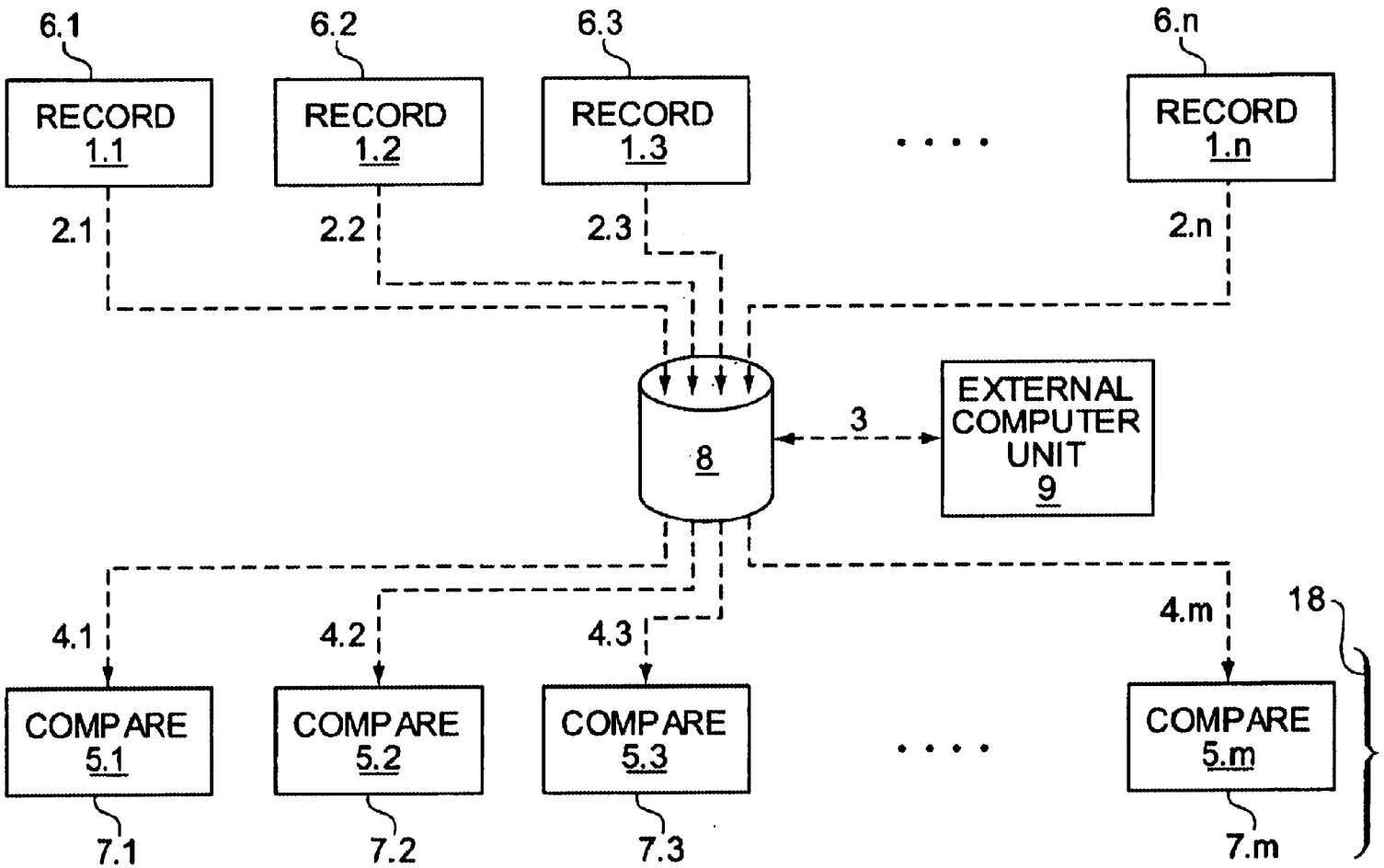
FIG. 1 depicts a method according to the present invention in accordance with one preferred embodiment.

In FIG. 1, the method according to the present invention for the predictive detection of errors in a motor vehicle 7.1, 7.2 through 7.m is presented in accordance with one preferred embodiment. The method is essentially composed of five steps. In a first step 1.1, 1.2 through 1.n, performance characteristics and information for characterizing the performance characteristics are recorded over a specific time period in a multiplicity of motor vehicles 6.1, 6.2, through 6.n, and they are stored in motor vehicles 6.1, 6.2 through 6.n. Motor vehicles 6.1, 6.2 through 6.n and motor vehicles 7.1, 7.2, through 7.m can be the same motor vehicles, partially the same, or different motor vehicles, which are nevertheless preferably of the same type.

In response to the occurrence of an error in one of motor vehicles 6.1, 6.2 through 6.n, the performance characteristics and information for characterizing the performance characteristics in motor vehicle 6.1, 6.2 through 6.n—especially in the time period before the occurrence of the error—are transmitted in a second step 2.1. 22 through 2.n to an external error storage unit 8.

In an external computer unit 9, which has access to external error storage unit 8, in a third step 3 an analysis of the performing characteristics is then carried out with the goal of identifying a characteristics model for the error occurring in motor vehicle 6.1, 6.2 through 6.n and of describing it in the appropriate form. Each error arising during operation in one of motor vehicles 6.1, 6.2 through 6.n has assigned to it in this manner a characteristic performance characteristics model, which is described in the appropriate manner. The description can be models using rules, or they can be mathematical functions such as products or convolutions.

In a fourth step 4.1, 4.2 through 4.m, the descriptions of the performance characteristics models are transmitted to a plurality of motor vehicles 7.1, 7.2 through 7.m. In these motor vehicles 7.1, 7.2 through 7.m, in a fifth step 5.1, 5.2 through 5.m, the currently recorded performance characteristics are compared with the descriptions of the performance characteristics models assigned to the individual errors.

Figure 2:
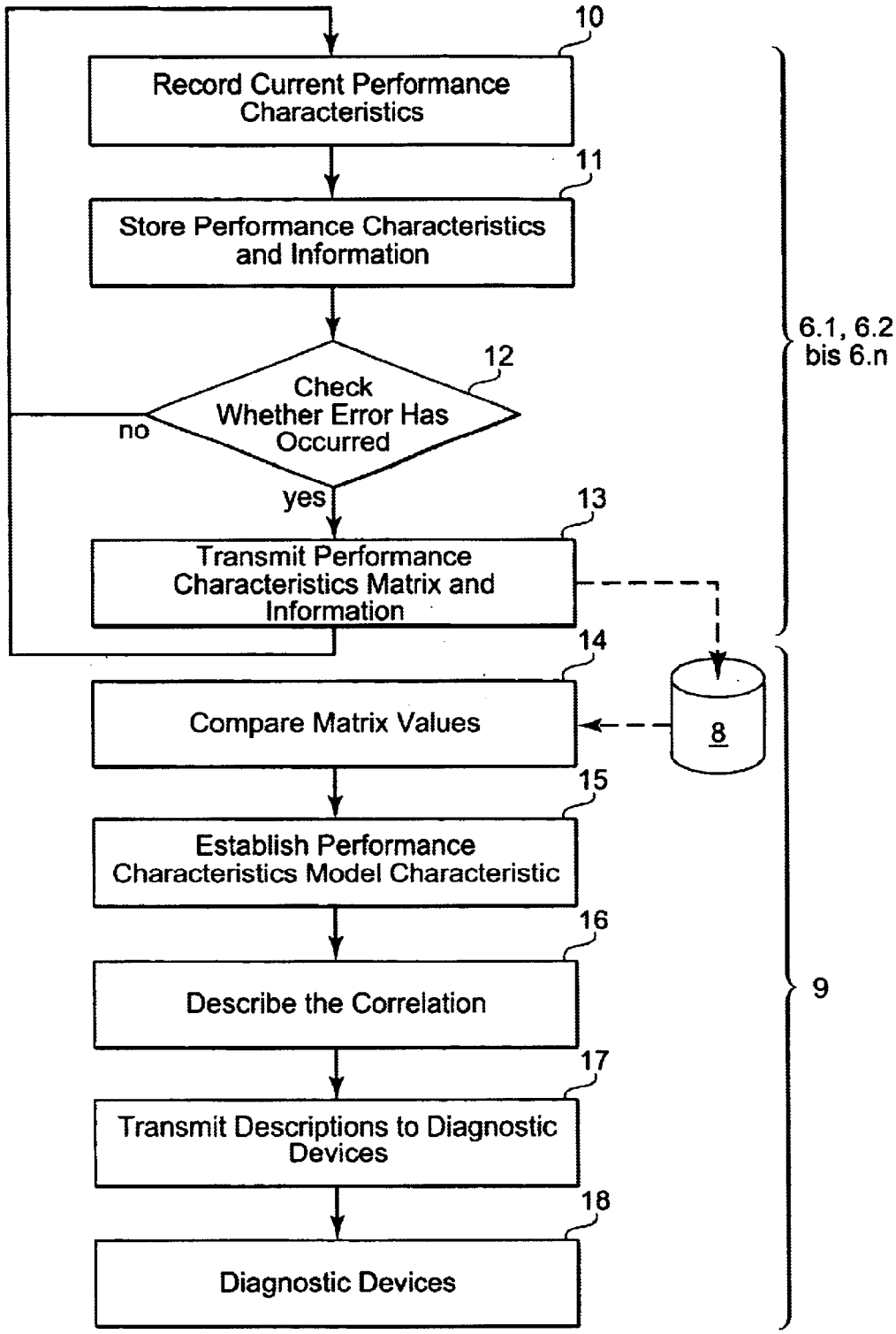
FIG. 2 depicts a flow chart for the empirical ascertainment of the performance characteristics models in a motor vehicle.

To explain steps 1 through 3, they are depicted in FIG. 2 as a flow chart for one of motor vehicles 6.1, 6.2 through 6.n. First, in function block 10, during the operation of motor vehicle 6.1, 6.2 through 6.n, current performance characteristics are recorded over a specific time period which can be different from motor vehicle to motor vehicle. By performance characteristics are meant all the information that describes the condition of motor vehicle 6.1, 6.2 through 6.n and of its environment. These are, for example, signals from sensors located in the motor vehicle (characteristic data of the internal combustion engine or of the driving dynamics of the motor vehicle) or from the environment sensor systems of the motor vehicle (temperature, humidity, or dust content of the ambient air). In addition, information for characterizing the performance characteristics, for example, the condition of systems, including any error codes arising, as well as date, time and/or location of the performance characteristics record are recorded.

The recorded performance characteristics and information are stored in a function block 11 for subsequent retrieval. The recorded performance characteristics are stored, for example, in the form of a performance characteristics matrix, the individual vectors corresponding to different performance characteristics, and the individual vector elements corresponding to the values of the performance characteristics at specific points in time.

In a query block 12, it is checked whether, during the operation of motor vehicle 6.1, 6.2 through 6.n, an error has occurred in the motor vehicle. The error can be, for example, the failure of a specific component or an unusual signal of a specific sensor. If no error is detected, then a branching occurs once again to function block 10 for receiving further performance characteristics. In the event an error has occurred, then, in a function block 13, the recorded performance characteristics matrix and information with respect to the error that has occurred (type, point in time, etc.) are transmitted to external error storage unit 8. It goes without saying that the transmission of the performance characteristics matrix and of the information does not have to occur immediately after the occurrence of the error. Rather, the data to be transmitted can be temporarily stored in a storage unit of motor vehicle 6.1, 6.2 through 6.n until it is transmitted. Steps 1 and 2 in accordance with blocks 10 through 13 are carried out in a motor vehicle 6.1, 6.2 through 6.n.

In contrast, step 3, described below, is carried out in an external computer unit 9, which has access to external error storage unit 8. In subsequent function blocks 14 through 18, the error that has arisen is diagnosed, and from the performance characteristics recorded before the occurrence of the error a so-called performance characteristics model is established and is assigned to the diagnosed error. In addition, an appropriate description of the performance characteristics model is determined and is transmitted to motor vehicle 7.1, 7.2 through 7.m.

More precisely, in function block 14, the values of the performance characteristics matrix assigned to the error are compared with the values of error-free performance characteristics matrices. The error-free performance characteristics matrices are derived from the subsets of motor vehicles 6.1, 6.2 through 6.n, in which this error has not occurred, and which have also transmitted their performance characteristics matrices to error storage unit 8.

From the comparison carried out in function block 14, a performance characteristics model characteristic of the error that has occurred is established in function block 15, the model being assigned to this error. In function block 16, the correlation between the performance characteristics model and the occurrence of an error is described in an appropriate form. For describing the correlation, the latter can be characterized in the form of rules or can be depicted using mathematical functions (e.g., convolutions or products). Through the description of the correlation, trivial correlations and redundant or unnecessary information can be eliminated. In this manner, in motor vehicles 7.1, 7.2 through 7.m, storage space and computing time can be saved for the comparison of the currently recorded performance characteristics with the descriptions that are assigned to specific errors.

The description of the correlations between the recorded performance characteristics and an error that has occurred is carried out for all of the errors that have occurred, so that finally a multiplicity of rules and/or mathematical functions is available for the various errors. In function block 17, the descriptions are then transmitted to diagnostic devices 18 in motor vehicles 7.1, 7.2 through 7.m for carrying out step 5.1, 5.2 through 5.m of the method according to the present invention.

In diagnostic devices 18, the actual method for the predictive detection of errors in a motor vehicle 7.1, 7.2 through 7.n is implemented. A diagnostic device 18, as is depicted in FIG. 1, can be configured as a vehicle-internal diagnostic device in motor vehicles 7.1, 7.2 through 7.n. The performance characteristics currently recorded in motor vehicles 7.1, 7.2 through 7.n are compared in the vehicle-internal diagnostic device with the descriptions of the performance characteristics models that characterize the errors. In this embodiment, the predictive diagnosis can be carried out during the operation of motor vehicle 7.1, 7.2 through 7.n.

Alterative, it is proposed that a diagnostic device 18 be configured as a vehicle-external diagnostic device, which is located, for example, in a garage. Then the currently recorded performance characteristics are transmitted from motor vehicle 7.1, 7.2 through 7.n to the vehicle-external diagnostic device, which has access to vehicle-external error storage unit 8. The currently recorded performance characteristics are compared in the vehicle-external diagnostic device with the descriptions of the performance characteristics models characterizing the errors. In this specific embodiment, the predictive diagnosis can be carried out, for example, in a garage.

What is claimed is:

1. A method for detecting errors in a motor vehicle, comprising the steps of:

recording performance characteristics and information for characterizing the performance characteristics in the motor vehicle over a specific period of time;

from the performance characteristics recorded before an occurrence of a specific one of the errors in the motor vehicle, generating one of a plurality of performance characteristics models assigned to the specific error;

describing the one of the performance characteristics models in an appropriate form;

comparing those of the recorded performance characteristics that are current during an operation of the motor vehicle with descriptions of the performance characteristics models characterizing the specific error; and assigning a specific one of the performance characteristics models to the specific error on the basis of the performance characteristics recorded in a plurality of motor vehicles;

wherein in the plurality of motor vehicles of a specific type, the same performance characteristics are recorded in each case.

2. The method according to claim 1, further comprising the steps of:

transmitting the recorded performance characteristics that are current, the information for characterizing the performance characteristics, and those of the errors that have occurred from the motor vehicles of the specific type to an error storage unit situated outside the motor vehicles; and storing the recorded performance characteristics that are current, the information for characterizing the performance characteristics, and those of the errors that have occurred from the motor vehicles of the specific type in the error storage unit.

3. The method according to claim 2, wherein:

the performance characteristics models include a specific performance characteristics model, the method further comprising the step of:

assigning the specific performance characteristics model to the specific error on the basis of the recorded performance characteristics stored in the error storage unit.

4. The method according to claim 3, further comprising the step of:

eliminating a plurality of trivial correlations from the descriptions of the performance characteristics models.

5. The method according to claim 4, further comprising the step of:

describing a correlation between one of the performance characteristics models and an occurrence of the specific error as one of a rule and a mathematical function.

6. The method according to claim 5, further comprising the steps of:

transmitting the one of the rule and the mathematical function from the error storage unit to a vehicle-internal diagnostic device of the motor vehicle; and comparing the recorded performance characteristics that are current in the vehicle-internal diagnostic device with the descriptions of the performance characteristics models characterizing the errors.

7. The method according to claim 5, further comprising the steps of:

transmitting the recorded performance characteristics that are current from the motor vehicle to a vehicle-external diagnostic device that has access to the error storage unit; and comparing the recorded performance characteristics that are current in the vehicle-external diagnostic device with the descriptions of the performance characteristics models.

8. A diagnostic device for performing a predictive detection of errors in a motor vehicle, comprising:

a computer unit for:

recording performance characteristics and information for characterizing the performance characteristics in the motor vehicle over a specific period of time;

from the performance characteristics recorded before an occurrence of a specific one of the errors in the motor vehicle, generating one of a plurality of performance characteristics models assigned to the specific error;

describing the one of the performance characteristics models in an appropriate form;

comparing those of the recorded performance characteristics that are current during an operation of the motor vehicle, wherein:

descriptions of the performance characteristics models characterize the specific error;

assigning a specific one of the performance characteristics models to the specific error on the basis of the performance characteristics recorded in a plurality of motor vehicles, wherein:

in the plurality of motor vehicles of a specific type, the same performance characteristics arm recorded in each case;

transmitting the recorded performance characteristics that are current, the information for characterizing the performance characteristics, and those of the errors that have occurred form the motor vehicles of the specific type to an error storage unit situated outside the motor vehicles;

storing the recorded performance characteristics that are current, the information for characterizing the performance characteristics, and those of the errors that have occurred from the motor vehicles of the specific type in the error storage unit, wherein:

the performance characteristics models include a specific performance characteristics model;

assigning the specific performance characteristics model to the specific error on the basis of the recorded performance characteristics stored in the error storage unit;

eliminating trivial correlations from the descriptions of the performance characteristics models;

describing a correlation between one of the performance characteristics models and an occurrence of the specific error as one of a rule and mathematical function;

transmitting the one of the rule and the mathematical function from the error storage unit to a vehicle-internal diagnostic device of the motor vehicle; and comparing the recorded performance characteristics that are current in the vehicle-internal diagnostic device with the descriptions of the performance characteristics models characterizing the errors.

* * * * *

UNITED STATES PATENT AND TRADEMARK OFFICE

CERTIFICATE OF CORRECTION

PATENT NO. : 6,766,232 B1
DATED : July 20, 2004
INVENTOR(S) : Markus Klausner

It is certified that error appears in the above-identified patent and that said Letters Patent is hereby corrected as shown below:

Column 10,
Line 13, change "performance characteristics arm" to -- performance characteristics are --.

Signed and Sealed this

Eleventh Day of October, 2005

JON W. DUDAS
*Director of the United States Patent and Trademark Office*